US009851192B2

(12) United States Patent
Donovan

(10) Patent No.: US 9,851,192 B2
(45) Date of Patent: Dec. 26, 2017

(54) METHOD AND APPARATUS FOR CONTAINING AND SUPPRESSING EXPLOSIVE DETONATIONS

(71) Applicant: John L. Donovan, Danvers, IL (US)

(72) Inventor: John L Donovan, Danvers, IL (US)

(73) Assignee: John L. Donovan, Danvers, IL (US)

( * ) Notice: Subject to any disclaimer, the term of this patent is extended or adjusted under 35 U.S.C. 154(b) by 733 days.

(21) Appl. No.: 13/833,060

(22) Filed: Mar. 15, 2013

(65) Prior Publication Data

US 2015/0266667 A1 Sep. 24, 2015

(51) Int. Cl.
*F42D 3/00* (2006.01)
*F42D 5/045* (2006.01)

(52) U.S. Cl.
CPC ..... *F42D 3/00* (2013.01); *F42D 5/045* (2013.01)

(58) Field of Classification Search
CPC ..... F42B 33/06; F42B 33/067; F42D 3/00; F42D 5/04–5/045; F23G 2209/16; Y10S 588/90
See application file for complete search history.

(56) References Cited

U.S. PATENT DOCUMENTS 3,800,715 A * 4/1974 Boller ..... F42B 33/067 109/1 R
4,187,758 A * 2/1980 Petty ..... F42B 39/14 109/74
4,632,041 A * 12/1986 Ohlson ..... F42D 5/04 109/1 S
4,686,911 A * 8/1987 Phillips ..... F42D 5/045 109/1 S (Continued)

FOREIGN PATENT DOCUMENTS

FR 2759354 A1 * 8/1998 ..... F42B 39/14
FR 2759354 A1 * 8/1998 ..... F42B 39/14

OTHER PUBLICATIONS

Machine generated translation of FR 2759354 A1, Aug. 1998, European Patent Office.*

(Continued)

*Primary Examiner* — Stephen Johnson
*Assistant Examiner* — Joshua T Semick
(74) *Attorney, Agent, or Firm* — Cook Alex Ltd.

(57) ABSTRACT

A transportable explosion chamber and method of operation for containing, controlling and suppressing explosive detonations, including the explosion surface hardening of impact-hardenable rail components. The apparatus comprises an elongate cylindrical steel containment vessel having an access door for introducing workpieces and a vent door for discharging explosion products. Both doors extend convexly into the vessel to facilitate the dissipation of explosion shock waves. Orificed vent pipes penetrate the vessel walls to controllably release explosion products into one or more exhaust manifolds. The vessel is surrounded and enclosed by steel skins supported by spaced octagonal steel support ribs fabricated by welding from interlocking elements. The hollows formed between the containment vessel and steel skins are filled with granular shock-damping silica sand which is introduced through filler openings at the top of the apparatus. To lighten the apparatus for transport, the shock-damping material may be drained through dump valves beneath the apparatus.

18 Claims, 5 Drawing Sheets

(56) References Cited

U.S. PATENT DOCUMENTS

| | | | | |
|---|---|---|---|---|
| 4,898,104 | A * | 2/1990 | Savoy | F42D 5/045 109/1 R |
| 5,613,453 | A | 3/1997 | Donovan | |
| 5,884,569 | A | 3/1999 | Donovan | |
| RE36,912 | E | 1/2000 | Donovan | |
| 6,173,662 | B1 * | 1/2001 | Donovan | F42B 33/06 110/193 |
| 6,354,181 | B1 | 3/2002 | Donovan | |
| 7,308,847 | B2 * | 12/2007 | Walker | F42D 5/045 86/50 |
| 7,506,568 | B2 * | 3/2009 | King | F42B 33/06 588/403 |
| 8,153,855 | B2 * | 4/2012 | Asahina | F42B 33/06 422/168 |
| 8,222,624 | B2 * | 7/2012 | Yanke | F42B 39/14 250/505.1 |
| 8,365,938 | B2 * | 2/2013 | Ohlson | F42D 5/045 220/293 |
| 8,621,973 | B2 * | 1/2014 | Abbe | F42D 5/045 86/50 |
| 2005/0115384 | A1 * | 6/2005 | Reynolds | B65F 1/02 86/50 |
| 2009/0126555 | A1 * | 5/2009 | Olsson | F42D 5/045 86/50 |
| 2011/0023759 | A1 * | 2/2011 | Waller | F41H 5/24 109/79 |

OTHER PUBLICATIONS

"MineARC Systems Refuge—chambers that provide a safe haven for miners trapped in a hazardous or toxic environment", Jan. 9, 2007, MineARC Systems, www.minear.com.*

Machine Translation of FR 2759354 A1 to Gilles, European Patent Office.*

* cited by examiner

METHOD AND APPARATUS FOR CONTAINING AND SUPPRESSING EXPLOSIVE DETONATIONS

FIELD OF THE INVENTION

This invention relates to a transportable apparatus and method of operation for containing, controlling and suppressing explosive detonations, including the explosion surface hardening of impact-hardenable rail components

BACKGROUND OF THE INVENTION

Explosives have many useful industrial applications. These include surface hardening of austenitic manganese alloy steels, surface deposition coating, welding of metallic components, compression molding of components from powders and granular media, and disposal of unwanted explosive or toxic materials, among others.

The prior art reflects many attempts to contain the explosion process for the suppression of noise, shock and noxious polluting explosion products. Many of these attempts are described in this inventor's prior patents, including U.S. Pat. No. 5,613,453 (now U.S. Pat. No. RE 36,912), which disclosure is incorporated herein by reference.

All of the above-mentioned prior art devices represent improvements over the methods first used for containing explosive detonations, particularly the explosion hardening of manganese steel rail components. This process involves placing an explosive-covered hardenable metal workpiece in an open field, or at the bottom of an open pit such an abandoned gravel pit, and setting off the explosion in the open air, which resulted in objectionable noise, dust, disturbance and contamination of the environment. In addition, the uncontrolled use of explosives in this way required great amounts of space, posed substantial danger to equipment and personnel, and had the undesirable effect of demolishing the ignition leads, the work piece support surface, and virtually everything else within the immediate vicinity of the explosion.

In the United States, the standard railroad track width is 56.5 inches (4' 8½") and the largest rail cars commonly used to carry heavy bulky items such as paperboard, lumber and palletized loads commonly have an external width of about 10.5 feet, an external length of about from 55 to 93 feet, and a maximum load capacity of between 70 and 100 tons (140,000 to 200,000 pounds). Loads of up to 42 feet in length are easily accommodated. In special situations, wider load of as much as 12½ feet can also be accommodated. The standard rail section length in the United States is 60 feet (18.3 m). (See: http://www.csx.com/index.cfm/customers/equipment/railroad-equipment/

For highway transport, the United States Department of Transportation has established specific limits for highway trailers of 102 inches wide, 13½ feet high and a gross weight of 80,000 pounds, though in special cases loads of up to 129,000 can be accommodated. Such highway trailers may vary in length of up to 53 feet. However, the rules in individual states may vary, and some may by special permit allow heavier and larger loads. In Europe, truck trailers are generally limited to about 61 feet and 80,000 pounds, although some countries such as Sweden permit larger loads. (See: http://en.wikipedia.org/wiki/Semi-trailer_truck)

As with this inventor's prior patents, it is a principal object of the present invention to provide an improved method and apparatus for containing, controlling and suppressing the effects of explosive detonations used for industrial purposes. The purpose of the invention is to provide a containment device which can contain and suppress each explosion so that it poses no hazard to surrounding plant and equipment, or to the environment.

It is a further object of the invention to provide such a chamber which is of a size and weight which makes it readily transportable by rail, by highway, or both, to its point of eventual use.

A particular design objective is to provide for such a transportable chamber having an empty weight (before the addition of shock-dampening wall filler material) of 110,000 lbs. or less. An alternative object is to provide a method of construction by which the chamber can be manufactured from the assembly by welding of individual prefabricated components.

SUMMARY OF THE INVENTION

The invention is a transportable explosion chamber apparatus and method of operation, for containing, controlling and suppressing explosive detonations, including but not limited to the explosion surface hardening of impact-hardenable rail components.

The chamber itself is an elongate cylindrical steel containment vessel having an access door for introducing workpieces and a vent door for discharging explosion products. Both doors extend convexly into the vessel to facilitate the dissipation of explosion shock waves. Orificed vent pipes penetrate the vessel walls to controllably release explosion products into one or more exhaust manifolds.

The containment vessel is surrounded and enclosed by steel skins supported by spaced octagonal steel support ribs fabricated by welding from interlocking elements. The hollows formed between the containment vessel and steel skins are filled with granular shock-damping silica sand which is introduced through filler openings at the top of the apparatus. To lighten the apparatus for transport, the shock-damping material may be drained through dump valves beneath the apparatus.

DETAILED DESCRIPTION OF THE INVENTION

Figure 1:
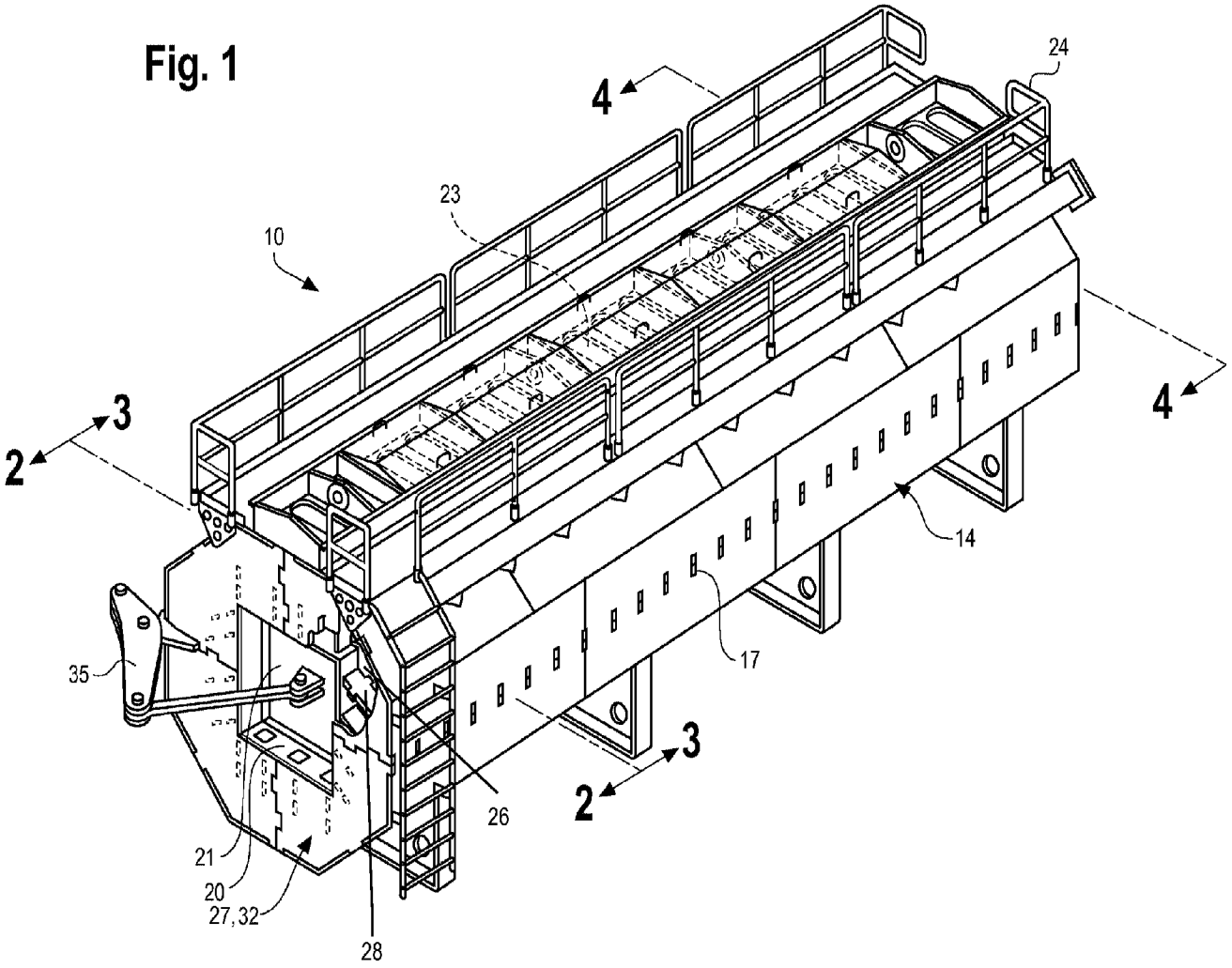
FIG. 1 is a perspective view of the chamber of the present invention, viewed from the front (entry door) end.
Figure 2:
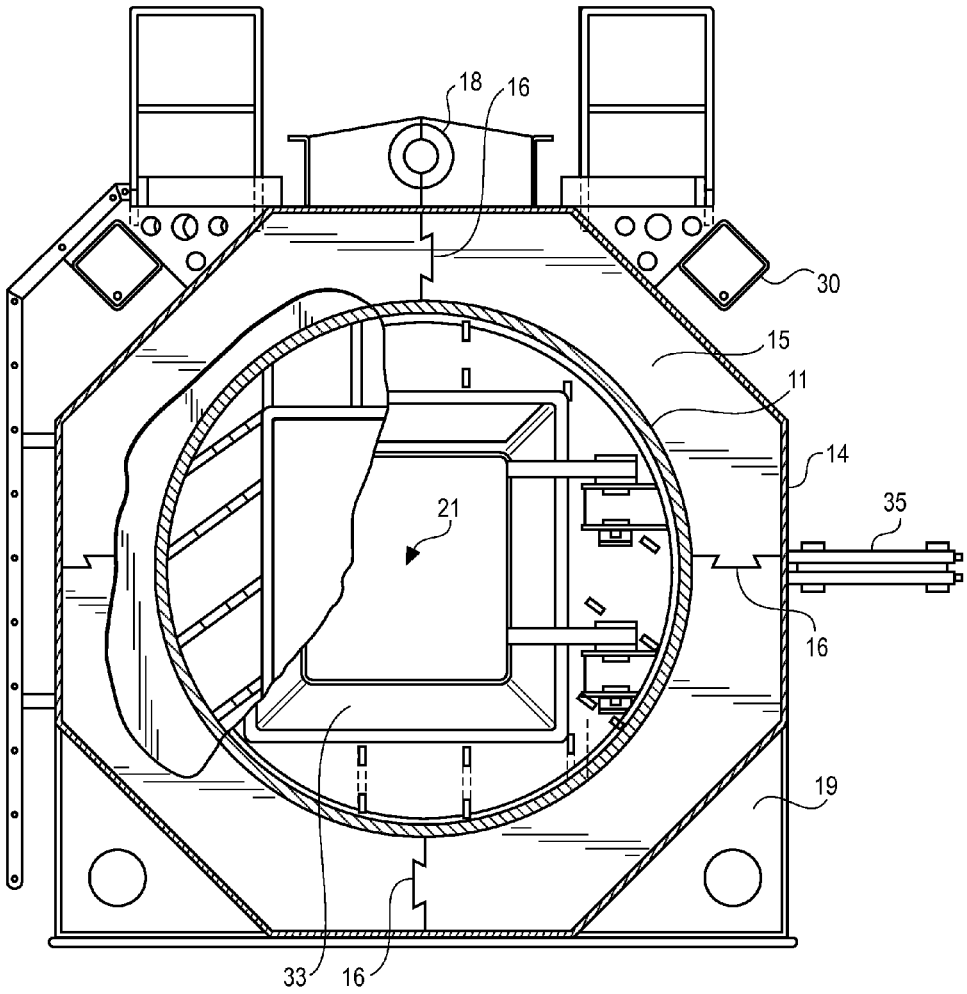
FIG. 2 is a front elevation of the chamber of the chamber taken in the plane 2-2 of FIG. 1.

Turning to FIG. 1, this isometric perspective view shows the assembled chamber ready for the introduction of an explosive or explosive-covered workpiece. In use, it would be bolted down and supported by a reinforced concrete footing or foundation (not shown) in a conventional manner.

As best shown in the remaining figures, the chamber assembly 10 comprises a cylindrical inner containment vessel 11 having an inward-swinging charging door 21 and a hemispherical end closure 12. The inner vessel 11 is preferably fabricated of sheet steel using conventional welding techniques. The vessel 11 is supported and strengthened by multiple equally-spaced parallel octagonal stiffener plates or ribs 13. In the illustrated embodiment, the inner containment vessel 11 is 34 feet long, and is supported by 25 ribs 13 which are equally spaced at 16 inch intervals. The assembled inner vessel 11 and surrounding ribs 13 are enclosed by an external enclosure formed of welded sheet steel skin plates 14.

Each stiffener plate or rib 13 is preferably fabricated from four symmetrical and mutually interlocking quadrants 15 which are sequentially welded together to surround and support the vessel 11 as the chamber assembly progresses. Each quadrant 15 is provided with dovetail-like joining means 16 whereby each rib sub-assembly, comprising four interlocking elements, is substantially self-supporting, making the final welding process significantly easier and more accurate. Each individual quadrant 15 is also provided with outward-facing lugs 17 which, after each group of four elements is welded together to form an individual rib 13, are enabled to engage a corresponding slot in its corresponding skin plate 14.

In addition, certain of the ribs 13 are provided with upstanding external lifting lugs 18 by which the chamber may be lifted and positioned for transport or use. Each of the ribs 13 of the present embodiment is made of one-inch steel plate. Certain of the ribs 13 are also provided with one-inch thick sheet steel external feet 19 positioned at spaced intervals on each side of the chamber along its length which are adapted to be bolted to an external reinforced concrete support structure (not shown). Upon delivery to its point of use, the fully assembled vessel 11, having been welded together as a self-supporting integral unit, is lifted from its transport means by means of the external lifting lugs 18, placed upon one or more reinforced concrete footings (not shown), and then bolted into place.

In the illustrated embodiment, the vessel 11 is made of pre-formed elements of ¾ inch welded steel plate. The completed vessel is 7½ feet in external diameter and 33 feet in overall length. The skin plates of the present embodiment are made of ⅜ inch steel plate. The forward end of the vessel 11 accepts a fabricated bulkhead 20 containing an inward-swinging charging door 21. The vessel 11 terminates at its opposite end in a hemispherical closure 12, where a smaller two-foot diameter opening and inward-swinging vent door 22 serve to exhaust the explosion products after each detonation.

Spaced along the top of the chamber assembly are individual access openings 23, each being covered by a hinged lid. The purpose of the openings is to allow the filling of the hollow spaces between the inner vessel 11 and external skin plates 14 with a granular shock-damping material such as silica sand in the manner taught by the inventor's prior U.S. Pat. No. 5,613,453 (now U.S. Pat. No. RE 36,912). If desired, a catwalk and safety railings 24 may be provided for inspection and access to the hollow spaces between the inner vessel 11 and skin plates 14.

Figure 3:
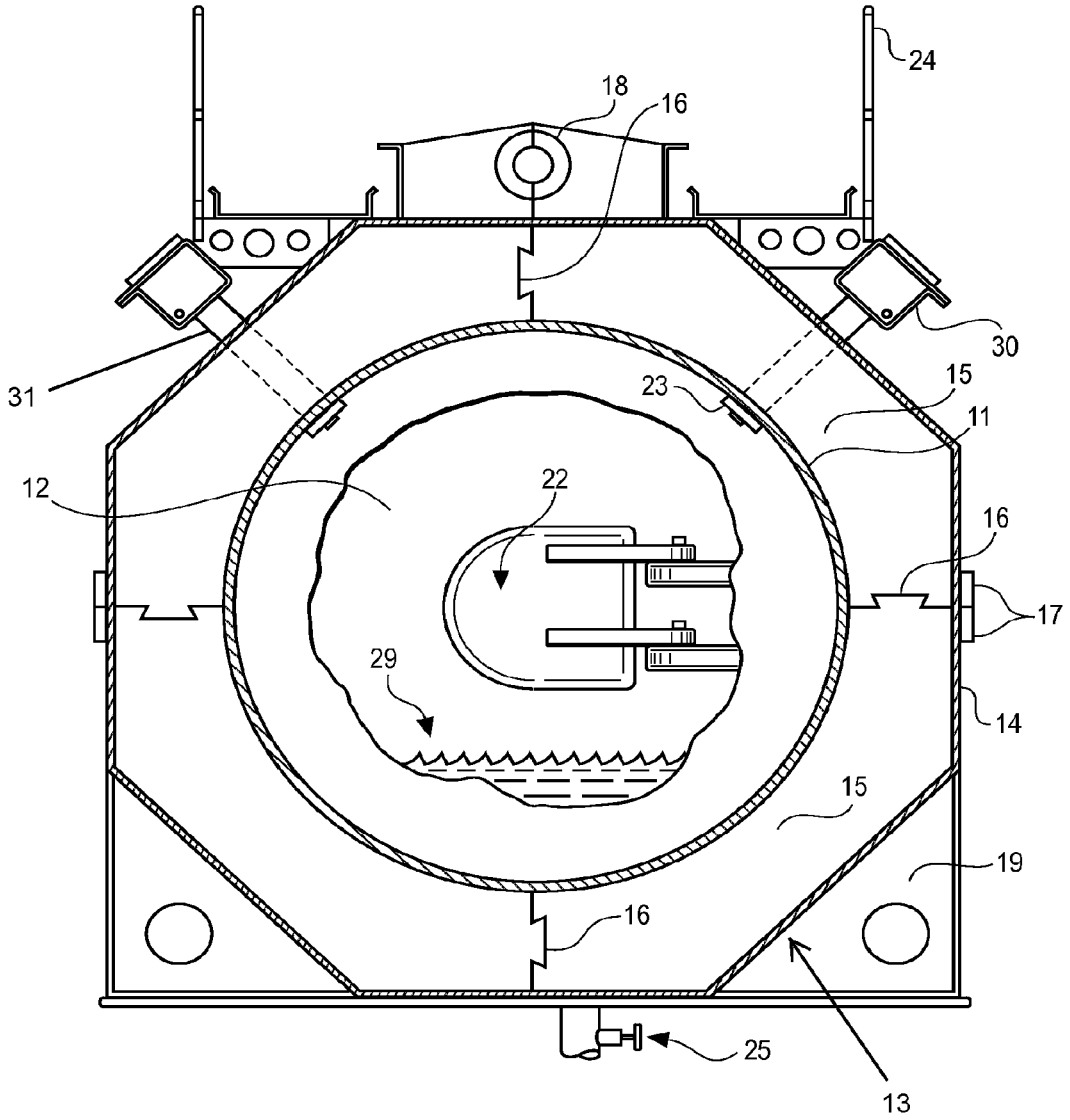
FIG. 3 is a cross sectional elevation of the chamber taken in the plane 3-3 of FIG. 1.
Figure 4:
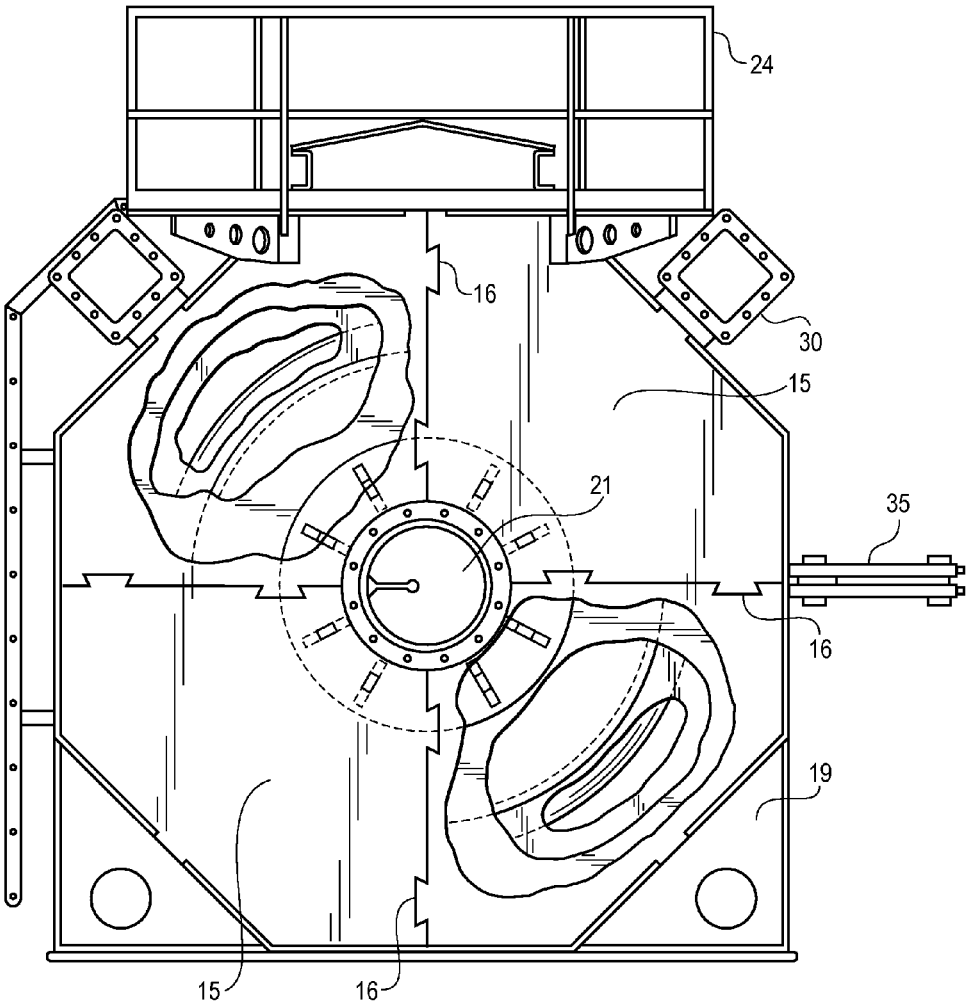
FIG. 4 is a cross sectional elevation of the chamber taken in the plane 4-4 of FIG. 1.
Figure 5:
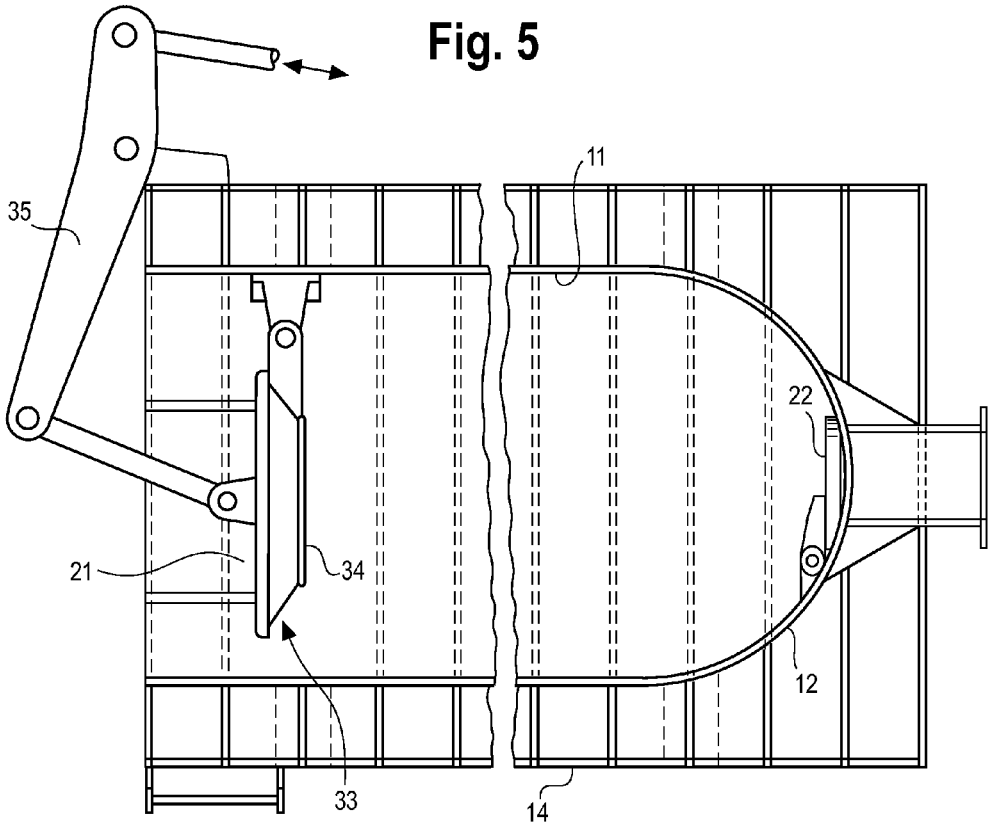
FIG. 5 is a cross-sectional plan view illustrating the front chamber closure bulkhead and inwardly-hinged charging door and the rear chamber hemispherical closure and inwardly-hinged vent door.
Figure 6:
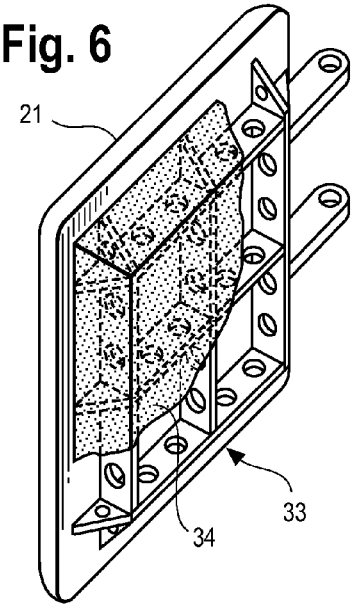
FIG. 6 is a detailed view of the front charging door showing its internal construction in partial phantom lines.
Figure 7:
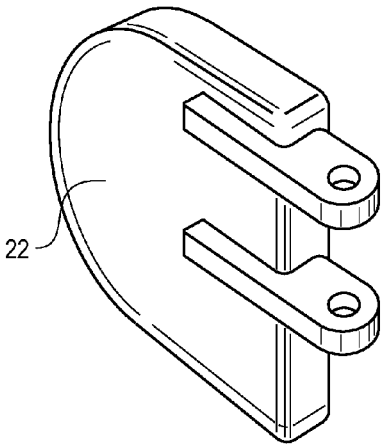
FIG. 7 is a detailed view of the rear vent door.

A significant advantage of the chamber of the present invention, compared to prior art devices, is that it can be moved relatively easily for use at a new location. In preparation, the shock-absorbing material is first drained from the hollow walls by means of dump valves 25 (FIG. 3), after which the chamber assembly may be unbolted from the its footings and lifted back onto a suitable transport means for transport to a new location.

As a feature of the invention, the forward bulkhead 20 which frames the charging door 21 is preferably fabricated from two parallel one-inch thick steel panels with a rear panel 26 welded to the front opening of the vessel 11 and joined to a front panel 27 panel by a plurality of inner struts 28, each of which is keyed to a corresponding slot in the front panel. The result is a strong and relatively light structure, which can, if desired, also be filled with shock-absorbing material.

Another important feature of the improved chamber is the shape of the hemispherical end closure 12 of the vessel 11. The hemispherical shape avoids as much as possible any acute interior corners or angles which, it has been found in practice, tend to focus and concentrate the impact of an explosive detonation within the chamber. The smoothly curved hemispherical surface, together with a relatively small vent door 22, largely avoids these problems.

For final assembly, the fabricated forward bulkhead 20, like the ribs 13, is joined to the vessel 11 by welding. The skin plates 14 are then attached by welding, the result being that the completed chamber assembly is a single monocoque (load-bearing skin) unit. At the bottom of the chamber assembly, spaced between the ribs 13, dump valves 25 permit the impact-deadening material to be readily jettisoned, which greatly lightens the chamber assembly for removal and transport.

When the chamber is used for surface hardening of manganese steel railroad track and track components, the chamber floor 29 is preferably covered with a bed of granular shock-damping material (FIG. 3), preferably pea gravel, to a uniform depth of about one foot, thereby forming a support surface for a rail work piece to be hardened, together with its layer of surface-hardening explosive which, when detonated, hardens the metal surface as is well known in the rail-hardening art. A suitable remotely operated ignition means (not shown) is provided to initiate each detonation in a conventional manner. In addition, individual plastic bags containing measured quantities of water (not shown) may be positioned along the length of the chamber in the manner taught by U.S. Pat. No. 5,613,453 (now U.S. Pat. No. RE 36,912) to further absorb and deaden the shock of the explosive detonation.

Another important feature of the improved detonation chamber is the provision of two parallel external detonation product exhaust manifolds 30 positioned atop the chamber unit. Each exhaust manifold communicates with the inner vessel 11 through a plurality of throttled vent pipes 31, each of which is fitted with a hardened steel orifice to control the rate of discharge of explosion products from detonations within the chamber. In the illustrated embodiment, each exhaust manifold is fitted with ten vent pipes 31 equally spaced along substantially the entire length of the inner vessel 11. Each exhaust manifold 30 may desirably be provided with suitable duct and fan means (not shown) for exhausting explosion products to a scrubber, bag filter, or other exhaust treatment device (not shown). In the illustrated embodiment, the manifolds are 12 inches square and fabricated of ½ inch sheet steel.

In the disclosed embodiment, the small vent door 22 is made of two-inch steel plate and hinged internally so as to close tightly against a corresponding door jamb at the rear of the vessel 11 so that a detonation pressure wave from within the vessel 11 causes the door to be pressed more tightly against the jamb, thus enhancing the seal until the pressure wave is dissipated through the throttle vent pipes 31 and exhaust manifolds 30.

Both the charging door and the exhaust door are internally hinged and inward-opening. In this way a detonation pressure wave from within the vessel 11 causes the door to be pressed more tightly against its frame. In the illustrated embodiment, the opening in the charging door bulkhead 20 is 60 inches high and 55 inches wide, permitting relatively easy entrance by personnel, or insertion of a rail workpiece by means of a forklift loader. The charging door 11 itself is larger, swinging inwardly and providing a continuous peripheral overlap of the door frame of about 2½ inches. A peripheral seal may be provided, preferably of silicone rubber or a similar heat-resistant material (not shown).

To achieve the objective of providing a readily transportable chamber assembly, the fabricated forward bulkhead 20 consists of two fabricated parallel octagonal frame members 32 spaced 16 inches apart, assembled from four interlocking pieces similar to the ribs 13. Each frame member, like the ribs 13, is of octagonal shape and formed of four interlocking segments, welded together. To save weight, the outermost door frame member is provided with spaced perforations or slots adapted to receive the cooperating tabs of a plurality of internal braces spaced around the periphery of the door opening, into which a rectangular frame liner is fitted. The parallel frame members, internal braces and rectangular frame liner are preferably made of the same one inch sheet steel, and on assembly are welded together into a single charging door unit, which though hollow is exceedingly strong. Openings may be provided at the top of the door unit though which a shock-absorbing material such as silica sand may be introduced.

In like fashion, the inward-opening charging door 21 is similarly fabricated from multiple pieces of sheet steel, with a beveled inward-facing surface in the shape of a truncated pyramid 33. The surfaces may be further protected by sheets of replaceable armor plate 34 if desired. This truncated pyramidal shape, like the hemispherical shape of the rear 11 of the vessel 11, serves to deflect direct blast pressures in a radial direction toward the walls of the vessel 11 and away from the door frame and internal hinges. Both the charging door and exhaust door, being hinged internally and directly exposed to each detonation, are of heavy construction, and the hinges may be armored as well. The charging door in the illustrated embodiment is operated externally by means of a bell-crank pivot 35 or other suitable means, preferably power-actuated. The inner faces of the charging door may be provided with sheets of replaceable armor plate for additional protection. Being hollow, the charging door 21 can also be filled with a shock-absorbing material in the same manner as the hollow forward bulkhead 20.

The invention claimed is:

1. A transportable explosion chamber, comprising:

an elongated cylindrical blast-resistant metal inner vessel, said inner vessel having at one end an access door opening and a blast-shielded access door, and at an opposite end a vent opening and a blast-shielded vent door, a plurality of fabricated support ribs surrounding said inner vessel, and a plurality of metal outer skin panels surrounding and enclosing said support ribs, thereby forming an external enclosure, wherein at least one of said support ribs is positioned between said one end and said opposite end of the inner vessel and is defined by a plurality of components that are joined together to surround the inner vessel.

2. A transportable explosion chamber, comprising:

an elongated cylindrical blast-resistant metal inner vessel, said inner vessel having at one end an access door opening and an inward-opening blast-shielded access door, and at an opposite end a vent opening and an inward-opening blast-shielded vent door, a plurality of fabricated support ribs surrounding said inner vessel, and a plurality of metal outer skin panels surrounding and enclosing said support ribs, thereby forming an elongated double-wall chamber assembly having a top, a bottom, and a plurality of hollow spaces formed between said inner vessel, support ribs and metal outer skin panels, wherein said inward-opening blast-shielded access door comprises a door plate substantially overlapping said door opening, and shield plates forming a truncated pyramid shape extending inwardly into the inner vessel to dissipate shock waves from explosive detonations.

3. The transportable explosion chamber of claim 1 in which the inner vessel, the external enclosure and the support ribs define a plurality of hollow spaces therebetween, wherein said plurality of hollow spaces are filled with granular shock-absorbing material.

4. The transportable explosion chamber of claim 3 further comprising a plurality of openable dump valves for emptying said granular shock-absorbing material from said hollow spaces to lighten said assembly for transport, wherein each hollow space includes at least one associated dump valve.

5. The transportable explosion chamber of claim 1 in which said inner vessel has a floor, with granular shock-absorbing material covering said floor and forming a support surface for an explosive to be detonated, and an ignition device for remotely detonating said explosive.

6. The transportable explosion chamber of claim 1 further comprising a fan for evacuating gaseous explosion combustion products of the detonation through the vent door, and drawing fresh air from the access door to fill the inner vessel after an explosion.

7. The transportable explosion chamber of claim 1 in which said metal inner vessel is of sufficient length to accommodate a section of railroad track rail.

8. A transportable explosion chamber, comprising:

an elongated cylindrical blast-resistant metal inner vessel, said inner vessel having at one end an access door opening and an inward-opening blast-shielded access door, and at an opposite end a vent opening and an inward-opening blast-shielded vent door, a plurality of fabricated support ribs surrounding said inner vessel, each comprising a plurality of individual interlocking components, and each said support rib rib having at its periphery outwardly-facing attachment tabs, and a plurality of metal outer skin panels surrounding and enclosing said support ribs, thereby forming an elongated double-wall chamber assembly having a top, a bottom, and a plurality of hollow spaces formed between said inner vessel, support ribs and metal outer skin panels.

9. The transportable explosion chamber of claim 8 wherein said metal outer skin panels have attachment slots cooperating with the attachment tabs on said support ribs.

10. The transportable explosion chamber of claim 1 wherein the inner vessel is axially symmetrical.

11. The transportable explosion chamber of claim 1 further comprising a plurality of vent pipes in fluid communication with the inner vessel and at least one elongated metal manifold for receiving and directing explosion products from the vent pipes, said manifold terminating at an external discharge point.

12. The transportable explosion chamber of claim 1 wherein said access door and vent door are inward-opening for causing said access and vent doors to seal tighter with increasing pressure within the inner vessel.

13. The transportable explosion chamber of claim 3 further comprising a plurality of closable access openings for introduction of said granular shock-absorbing material into said plurality of hollow spaces, wherein each said hollow space includes at least one of said access openings.

14. The transportable explosion chamber of claim 7 wherein the transportable explosion chamber has an empty weight of 110,000 pounds or less.

15. A transportable explosion chamber, comprising:

an elongated cylindrical blast-resistant metal inner vessel, said inner vessel having at one end an access door opening and a blast-shielded access door, and at an opposite end a vent opening and a blast-shielded vent door, a plurality of fabricated support ribs surrounding said inner vessel, and a plurality of metal outer skin panels surrounding and enclosing said support ribs, thereby forming an external enclosure, wherein each said support rib has a substantially circular inner perimeter and/or a substantially octagonal outer perimeter.

16. A transportable explosion chamber, comprising:

an elongated cylindrical blast-resistant metal inner vessel, said inner vessel having at one end an access door opening and a blast-shielded access door, and at an opposite end a vent opening and a blast-shielded vent door, a plurality of fabricated support ribs surrounding said inner vessel, and a plurality of metal outer skin panels surrounding and enclosing said support ribs, thereby forming an external enclosure, wherein each said support rib comprises a plurality of similarly shaped, interlocking components.

17. A transportable explosion chamber, comprising:

an elongated cylindrical blast-resistant metal inner vessel, said inner vessel having at one end an access door opening and a blast-shielded access door, and at an opposite end a vent opening and a blast-shielded vent door, a plurality of fabricated support ribs surrounding said inner vessel, a plurality of metal outer skin panels surrounding and enclosing said support ribs, thereby forming an external enclosure, and a bulkhead framing the access door opening and comprising a rear panel positioned adjacent to said one end of the inner vessel, a front panel oriented parallel to and spaced from the rear panel, and a plurality of inner struts extending between the front and rear panels.

18. The transportable explosion chamber of claim 17 wherein the front and rear panels comprise a plurality of similarly shaped, interlocking components.

* * * * *